United States Patent [19]

Bonin

[11] 4,188,175

[45] Feb. 12, 1980

[54] FUEL INJECTION PUMPS FOR INTERNAL COMBUSTION ENGINES

[75] Inventor: Jean-Claude Bonin, Blois, France

[73] Assignee: CAV RotoDiesel, Blois, France

[21] Appl. No.: 840,419

[22] Filed: Oct. 7, 1977

[30] Foreign Application Priority Data

Oct. 11, 1976 [FR] France ..... 76 30446

[51] Int. Cl.[2] ..... F04B 19/02; F04B 29/00

[52] U.S. Cl. ..... 417/462

[58] Field of Search ..... 417/462; 91/197, 498

[56] References Cited

U.S. PATENT DOCUMENTS

| | | | |
|---|---|---|---|
| 2,651,999 | 9/1953 | Harrington | 417/462 |
| 2,815,718 | 12/1957 | Avery | 91/498 |
| 2,828,697 | 4/1958 | Roosa | 417/488 |
| 2,882,831 | 4/1959 | Danneuig | 91/498 |
| 3,161,183 | 12/1964 | Lenth | 91/197 |

FOREIGN PATENT DOCUMENTS

| | | | |
|---|---|---|---|
| 112214 | 10/1964 | Czechoslovakia | 417/462 |
| 2261988 | 6/1973 | Fed. Rep. of Germany | 417/462 |
| 1383466 | 2/1975 | United Kingdom | 417/462 |

*Primary Examiner*—William L. Freeh

*Attorney, Agent, or Firm*—Finnegan, Henderson, Farabow, Garrett & Dunner

[57] ABSTRACT

A fuel injection pump for internal combustion engines, comprising a rotor formed with at least one transverse cylinder-shaped bore in which are slidably mounted two pumping plungers. An inward movement is imparted to the plungers, as the rotor rotates, by cam lobes formed on the inner periphery of a fixed ring and acting on the plungers via respective rollers.

The axis of the bore and the rotor's axis of rotation do not intersect each other, the distance between these two axes being such that the rollers are simultaneously engaged by two cam lobes and the distance is minimum under this condition.

4 Claims, 4 Drawing Figures

FUEL INJECTION PUMPS FOR INTERNAL COMBUSTION ENGINES

The invention relates to fuel injection pumps for supplying fuel to internal combustion engines and particularly to diesel engines.

Fuel injection pumps are known which comprise a housing, a rotor mounted for rotation within the housing and arranged to be driven in timed relationship with the engine, a transverse bore formed in the rotor, a pair of plungers slidably mounted in said bore, a cam ring surrounding said rotor and formed with cam lobes on its internal periphery, a pair of rollers engaging the internal periphery of the cam ring, roller shoes for respectively supporting said rollers, said roller shoes being in engagement with the outer end of the plungers, whereby, as the rotor rotates, an inward movement is imparted to the plungers.

In the conventional pumps of this type, the axis of the bore in which the plungers are received intersects the rotor's axis of rotation, and the cam lobes are therefore diametrically disposed two by two. The number of cam lobes is therefore necessarily an even number.

This conventional arrangement does not give rise to any problem in the case of engines with an even number of cylinders, as the number of cam lobes equals the number of cylinders, but difficulties arise in the case where the engine has an odd number of cylinders. In the conventional solution to the latter case, the number of cam lobes in fact is twice the number of cylinders. The result is that the number of injection strokes of the plungers is twice the number of cylinders, which calls for diverting one injection out of two. This required diversion of one injection out of two is a disadvantageous solution requiring additional equipment to deviate the fuel towards the accumulator. Moreover, the large number of cam lobes makes the practical profiling of the cam a very difficult operation.

In addition, the aforementioned conventional arrangement is not applicable to all types of engines with an even number of cylinders. For example, the conventional arrangement is not applicable when the engine running unit cycle corresponds not to one, but to two successive ignitions. In such a case, two successive ignitions should correspond to different rotation angles of the rotor and, accordingly, the angles between two successive cam lobes should take alternately two different values.

In view of obvious geometric considerations, the conventional arrangement is not compatible with such a distribution of the cam lobes when the engine cylinders are even in number, but not a multiple of 4. This is particularly the case of the six cylinder engines, and the problem arises especially with the six-cylinder V-engines where the V angle is different from 60° and 120° (for instance 90°) because of the required manufacturing standardization or engine balancing.

The object of the invention is to provide an injection pump of the aforementioned type free from the above mentioned disadvantages, and to this purpose, the axis of the bore in which are mounted the plungers and the rotor's axis of rotation do not intersect each other. The distance between these two axes is such that the two rollers are simultaneously engaged by the two cam lobes, the distance being minimum under this condition.

The number of cam lobes may therefore in all cases be chosen equal to the number of cylinders, and each injection is used.

In the case of a three-cylinder engine with regular ignition, there will be three cam lobes, equiangularly distributed, the two rollers being accordingly engaged simultaneously by the two cam lobes angularly spaced apart by 120°.

In the case of a five cylinder engine with regular ignition, the two rollers will be simultaneously engaged by two non-consecutive cam lobes, but angularly spaced apart by 144° ($2\cdot(2\pi/5)$ rd). The distance between the axis of the plungers and the rotor's axis of rotation is smaller than with the three-cylinder engine.

For a six-cylinder engine with irregular ignition different angles x and y between consecutive cam lobes will alternate, while the sum $x+y$ must be equal to 120°. The two cam lobes which engage simultaneously the rollers will be angularly spaced apart by 120° in all cases. The pump is thereby adapted to an engine with a running unit cycle corresponding to a rotation of 120°, instead of 60° for a regular ignition.

The invention will become more apparent from the following description of some embodiments, taken in conjunction with the accompanying drawing wherein.

Figure 1:
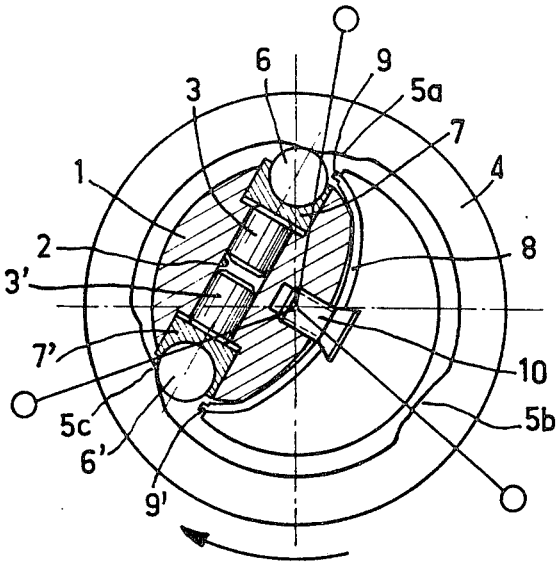
FIG. 1 is a simplified cross-sectional view of a pump according to the invention for a three-cylinder engine.

The injection pump shown in FIG. 1, which is provided for supplying fuel to a three-cylinder engine, comprises a rotor 1 with a bore 2 forming a cylinder for pumping plungers 3, 3'. In known manner, there is provided a cam ring 4 secured to the stator (not shown) of the pump, which is formed on its inner periphery with cam lobes *5a*, *5b*, *5c* angularly equidistant, the position of each cam lobe being illustrated by a full line terminating with a circle. These cam lobes, as the rotor rotates about its axis of rotation, engage rollers 6, 6', carried by roller shoes 7, 7' mounted in appropriately shaped recesses arranged in the rotor, to impart an inward movement to plungers 3, 3' thereby to deliver fuel through a delivery passage (not shown) towards the injection nozzles of the engine.

The distribution portion of the pump has not been shown on the drawing since it is quite conventional. It will suffice to point out that the opening of the delivery passage is brought in succession, during rotation of the rotor, into register with delivery outlets formed in the stator and communicating each with an injection nozzle of the engine.

According to the invention, the axis of the bore 2 and the rotor's axis of rotation do not intersect each other, in opposition to conventional pumps, as can be seen on the drawing, the distance between the two axes being such that the two rollers 6, 6' are simultaneously engaged by two of the three cam lobes.

Under such conditions, a complete rotation of the rotor effectively corresponds to three injections, one for each engine cylinder. It should be understood that the arrangement of the passage which connects the space between the plungers to the distribution portion will depend on the distance between the rotor's axis of rotation and the chamber defined between plungers 3, 3'. If this distance is relatively large, as in FIG. 1, the passage which extends through the distribution portion according to the rotor axis will comprise an inclined section relative to the axis opening into the chamber defined between the plungers.

The pump of FIG. 1 further comprises a flexible blade 8, with its ends 9, 9' serving as outward stop members respectively for roller shoes 7, 7'. The radial position of ends 9, 9' may be adjusted by means of a screw 10 which defines the bending of blade 8. Moreover, the contact surfaces of roller shoes 7, 7' and ends 9, 9' may have an axial configuration such as described in French Pat. No. 71 46180 and patent of addition No. 73 09050, for instance a continuous inclined shape or a discontinuous shape, thereby allowing modification of the outermost position of plungers 3, 3' and hence the fuel amount supplied by the pump, as a function of the engine running parameters. In this case, the roller shoes are axially displaceable by members responsive to said parameters, described in the aforementioned patent and patent of addition.

Figure 2:
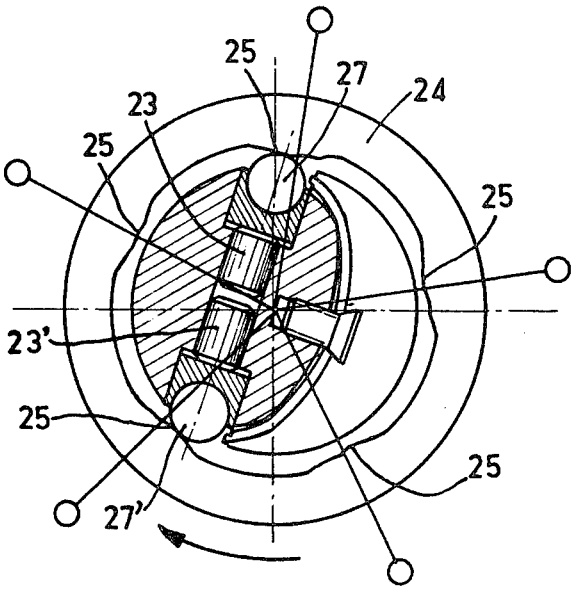
FIG. 2 is a view similar to that of FIG. 1, but showing a pump for a five-cylinder engine.

The pump shown in FIG. 2 is provided for supplying a five-cylinder engine, and to this effect the cam ring 24 is formed with five cam lobes 25 angularly equidistant, the arrangement of which is illustrated by full lines terminating with a circle.

It can be seen from FIG. 2 that both rollers 27, 27' are simultaneously engaged by two cam lobes spaced apart by an angle of $2\cdot(360°/5)=144°$.

Figure 3:
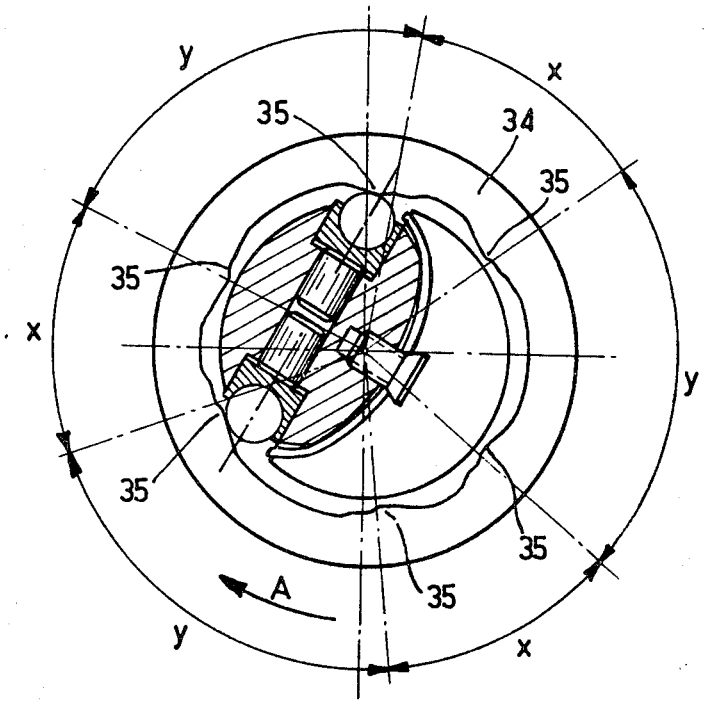
FIG. 3 is a view similar to that of FIGS. 1 and 2, but showing a pump for a six-cylinder engine with irregular ignition.

The pump shown in FIG. 3 is adapted to supply a six-cylinder engine with irregular ignition, the crankshaft rotation angles for successive ignitions having alternate values of 90° and 150°.

In order to properly provide fuel for a six-cylinder engine in which two consecutive ignitions correspond to two different rotations of the pump, the cam ring 34 is formed with six cam lobes 35 angularly non-equidistant but distributed in the shown manner: the consecutive cam lobes are spaced apart by angles having alternately a value x and a value y. It has been found that the angles spacing apart the consecutive cam lobes for a pump supplying a $(4p+2)$ cylinder engine having irregular ignition, where p is a positive integer, assume alternatively different values x and y, the sum $(x+y)$ being equal to $(2/4p+2)\cdot 360°$. Applying this formula to a six-cylinder engine, the sum $x+y$ is 120°. In the present case, x is equal to $90/2=45°$ and y is $150/2=75°$.

As can be seen from the drawing, the distance between the axis of the plungers and the rotor's axis of rotation is such that rollers 37, 37' are simultaneously engaged by two cam lobes angularly spaced apart by an angle of 120°.

When starting from the rotor position shown in FIG. 3, with a clockwise rotation of the rotor (arrow A), the first ignition will correspond to a rotation angle x, the second to a rotation angle y, the third to a rotation angle x, etc.

Figure 4:
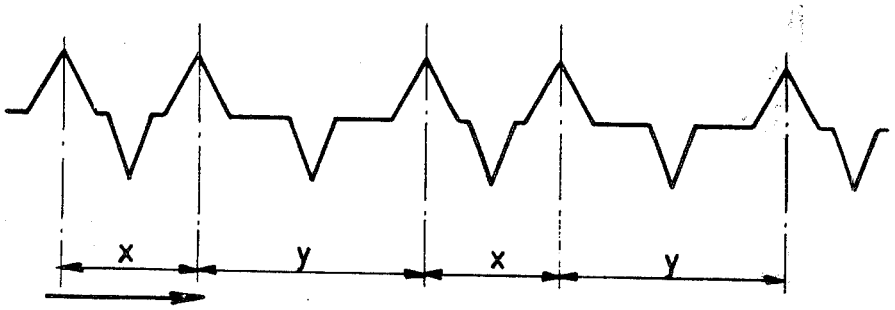
FIG. 4 is a symbolic operation diagram of the engine supplied by the pump of FIG. 3.

This running has been illustrated in the diagram of FIG. 4 where the rotation of the pump is plotted on the x-axis. The upper triangles show the delivery steps and the lower triangles the feed steps of the pump.

The diagram shows that the running unit cycle of the engine, that is, the rotation angle after which the engine starts an identical cycle, is equal to 120°. In the case of a six-cylinder engine with regular ignition, said unit cycle would be of 60°.

The interest of such an engine with irregular ignition lies in improved manufacturing standardization (the V angle being identical for four-cylinder, six-cylinder end eight-cylinder engines) and/or in a reduction of the engine vibrations, the running frequency being divided in half.

What I claim is:

1. An injection pump for supplying fuel to an internal combustion engine, comprising:
   - a housing,
   - a rotor mounted for rotation within the housing and arranged to be driven in timed relationship with the engine,
   - a transverse bore formed in the rotor,
   - a pair of plungers slidably mounted in said bore,
   - a cam ring surrounding said rotor and formed with cam lobes on its internal periphery,
   - a pair of rollers engaging the internal periphery of the cam ring, and
   - roller shoes for respectively supporting said rollers, said roller shoes being respectively in engagement with the outer ends of the plungers, whereby, as the rotor rotates about its axis of rotation, an inward movement is imparted to the rollers,
   - the axis of the bore in which the plungers are mounted and the rotor's axis of rotation not intersecting with each other, whereby, the rollers are angularly spaced from each other, with respect to the rotor's axis of rotation, by an angle less than 180°,
   - the distance between the axis of the bore and the rotor's axis of rotation being such that upon rotation of the rotor about its axis of rotation the two rollers are simultaneously engaged and disengaged by pairs of cam lobes.

2. An injection pump according to claim 1, for supplying an engine having an odd number of cylinders and regular ignition, wherein the cam lobes are angularly equidistant about the cam ring.

3. An injection pump according to claim 1, for supplying a $(4p+2)$ cylinder engine having irregular ignition, p being a positive integer, wherein the angles spacing apart the consecutive cam lobes assume alternately different values x and y, the sum $(x+y)$ being equal to $(2/4p+2)\cdot 360°$.

4. An injection pump for supplying fuel to an internal combustion engine having $(4p+2)$ cylinders and an irregular ignition, p being a positive integer, comprising:
   - a housing,
   - a rotor mounted for rotation within the housing and arranged to be driven in timed relationship with the engine,
   - a transverse bore formed in the rotor,
   - a pair of plungers slidably mounted in said bore,
   - a cam ring surrounding said rotor and formed with cam lobes on its internal periphery, the angles spacing apart the consecutive cam lobes assuming alternately different values, x and y, the sum $(x+y)$ being equal to $(2/4p+2)\times 360°$,
   - a pair of rollers engaging the internal periphery of the cam ring, and
   - roller shoes for respectively supporting said rollers, said roller shoes being respectively in engagement with the outer ends of the plungers, whereby, as the rotor rotates about its axis of rotation, an inward movement is imparted to the plungers, the axis of the bore in which the plungers are mounted and the rotor's axis of rotation not intersecting with each other, whereby, the rollers are angularly spaced from each other, with respect to the rotor's axis of rotation, by an angle less than 180°, the distance between the rotor's axis of rotation and the axis of the bore being such that upon rotation of the rotor about its axis of rotation, the two rollers are simultaneously engaged and disengaged by pairs of cam lobes.

* * * * *